US010458657B2

(12) United States Patent
Tisselli et al.

(10) Patent No.: US 10,458,657 B2
(45) Date of Patent: Oct. 29, 2019

(54) BURNER GRATE, GAS COOKING HOB, GAS STOVE TOP AND GAS STOVE

(71) Applicant: Electrolux Home Products Corporation N.V., Brussels (BE)

(72) Inventors: Filippo Tisselli, Forli (IT); Filippo Zanetti, Forli (IT); Peter Negretti, Forli (IT)

(73) Assignee: Electrolux Home Products Corporation N.V., Brussels (BE)

( * ) Notice: Subject to any disclaimer, the term of this patent is extended or adjusted under 35 U.S.C. 154(b) by 324 days.

(21) Appl. No.: 14/347,524

(22) PCT Filed: Oct. 24, 2012

(86) PCT No.: PCT/EP2012/071024
§ 371 (c)(1),
(2) Date: Mar. 26, 2014

(87) PCT Pub. No.: WO2013/068230
PCT Pub. Date: May 16, 2013

(65) Prior Publication Data

US 2014/0246009 A1 Sep. 4, 2014

(30) Foreign Application Priority Data

Nov. 10, 2011 (EP) ..... 11188572

(51) Int. Cl.
*F24C 3/08* (2006.01)
*F24C 15/10* (2006.01)

(52) U.S. Cl.
CPC ..... *F24C 3/08* (2013.01); *F24C 15/107* (2013.01)

(58) Field of Classification Search
CPC ..... F24C 15/101; F24C 15/107; F24C 3/08
See application file for complete search history.

(56) References Cited

U.S. PATENT DOCUMENTS 925,570 A * 6/1909 Eckert ..... A47J 37/0704 110/308
1,626,047 A * 4/1927 Morley ..... F24C 3/08 126/39 J (Continued)

FOREIGN PATENT DOCUMENTS

DE 3708020 A1 * 9/1988 ..... F23B 1/16
EP 0581655 A1 * 2/1994 ..... F24C 3/085

(Continued)

OTHER PUBLICATIONS

International Search Report for PCT/EP2012/071024, dated Dec. 11, 2012, 2 pages.

*Primary Examiner* — Kenneth Rinehart
*Assistant Examiner* — Logan P Jones
(74) *Attorney, Agent, or Firm* — Pearne & Gordon LLP

(57) ABSTRACT

The invention is directed to a burner grate (7), gas cooking hob, gas stove top and gas stove. For obtaining sufficient secondary air supply for inner flame exit ports (6) of a gas burner (4) of a gas cooking hob (3), a burner grate (7) adapted to be placed over the gas burner (4) and to support cooking vessels placed on the gas cooking hob (3) is proposed, which burner grate (7) comprises a feeder duct (12) extending from an outer region (13) to a mid section (14) thereof, and is adapted and implemented for feeding air towards flames of inner flame exit ports (6).

16 Claims, 4 Drawing Sheets

(56) References Cited

Figure 1:
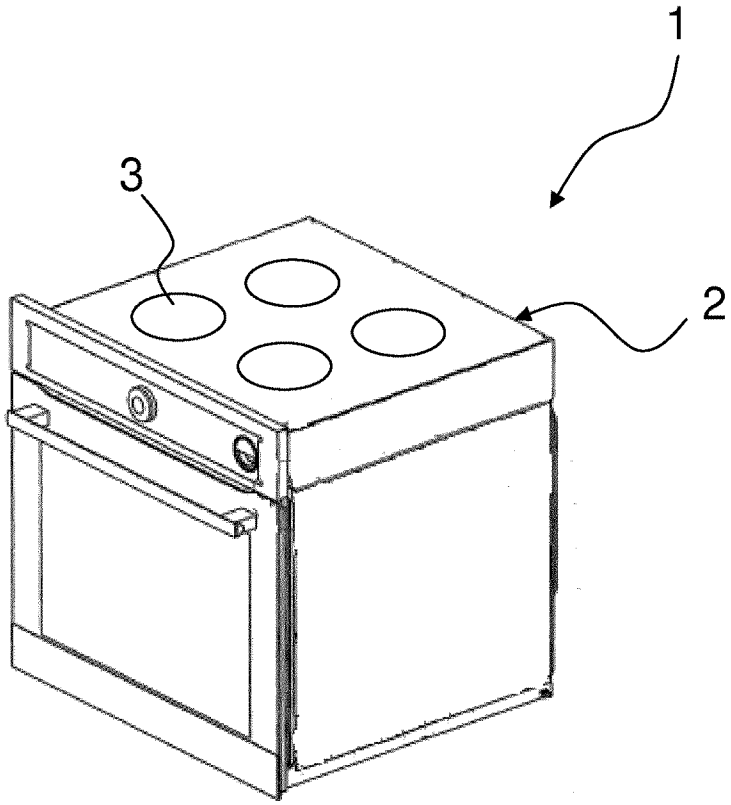

U.S. PATENT DOCUMENTS 1,697,184 A * 1/1929 Harner ..... F24C 15/107 126/214 C
2,440,035 A * 4/1948 Williams ..... F24C 15/107 126/214 C
2,480,046 A * 8/1949 Reeves ..... F24C 15/10 126/214 C
2,950,669 A * 8/1960 Terry ..... A47J 37/0754 126/25 B
3,269,383 A * 8/1966 Maasberg ..... F23H 3/00 126/163 R
3,854,456 A * 12/1974 Ishii ..... F02B 53/00 123/203
3,898,019 A * 8/1975 Reznick ..... F04D 25/166 417/362
4,343,288 A * 8/1982 Tjosvold ..... F23L 9/02 126/112
4,360,000 A * 11/1982 Down ..... F24B 7/025 126/163 R
4,771,760 A * 9/1988 Whiteley ..... F24B 1/193 126/163 R
4,920,866 A * 5/1990 Hoban ..... F23L 17/16 110/160
5,076,258 A * 12/1991 Gongwer ..... A47J 37/00 126/146
6,279,567 B1 * 8/2001 Taplan ..... F24C 15/107 126/215
7,721,727 B2 * 5/2010 Kobayashi ..... F24C 3/085 126/152 B
7,895,999 B2 * 3/2011 Graham ..... F23D 14/105 126/215
8,479,721 B2 * 7/2013 Graham ..... F23D 14/105 126/1 R
2005/0066956 A1 * 3/2005 Sung ..... A47J 37/067 126/25 R
2007/0137634 A1 * 6/2007 Traeger ..... A47J 37/0704 126/29
2007/0145032 A1 * 6/2007 Graham ..... F23D 14/105 219/392
2007/0199558 A1 * 8/2007 Kobayashi ..... F24C 3/085 126/39 E
2012/0304978 A1 * 12/2012 De Gaspari ..... F23D 14/06 126/15 R

FOREIGN PATENT DOCUMENTS

EP 0878666 A2 * 11/1998 ..... F24C 3/085
EP 1016823 A1 * 7/2000 ..... F23C 7/02
EP 1830133 9/2007
EP 2072901 6/2009
GB 167730 A * 8/1921 ..... F24C 3/08
JP 58064416 A * 4/1983 ..... F23D 14/085

* cited by examiner

BURNER GRATE, GAS COOKING HOB, GAS STOVE TOP AND GAS STOVE

The invention is directed to a burner grate, gas cooking hob, gas stove top and gas stove.

Gas burners for household gas stove tops are known in many different configurations, in particular with respect to flame outlet ports of burner caps.

For example, EP 2 290 287 A2 discloses a circular burner cap which has on its top face a plurality of flame outlet ports arranged in concentric circular sections. One challenge with such burner caps is to obtain satisfactory secondary air supply to the plurality of flame outlet ports, in particular to flame outlet ports arranged in inner sections of the burner cap.

In EP 1 207 351 A1 a gas cooking hob is known, in which a gas burner is covered by a dome. Lateral openings in the dome are provided for supplying primary and secondary air to flame outlet ports of the burner positioned under the dome. Also in this gas cooking hob, secondary air supply to the flame outlet ports still could be improved.

It is therefore an object of the invention to provide measures for enhancing secondary air supply to flame outlet ports and flames of a gas burner. In particular, secondary air supply to flame outlet ports and flames located in inner regions of a gas burner or burner cap shall be provided.

In particular, and under similar considerations as mentioned beforehand, a gas cooking hob, a burner grate, a gas stove top and a gas stove shall be provided.

These objects are solved by claims 1, 4, 7 and 14. Embodiments result from respective dependent claims.

According to claim 1, a burner grate is provided. The burner grate is adapted and implemented to be placed over a gas burner of a gas cooking hob.

The term "placed over the gas burner" in particular shall mean, that the burner grate at least covers or extends over the top face side of the gas burner. In general, the burner grate extends in lateral direction beyond the gas burner and is supported on a cooking face. The burner grate may be fixed, i. e. attached, to the cooking face, or just placed, in particularly removably placed.

Further, the proposed burner grate is adapted and implemented to support cooking vessels placed on the gas cooking hob. This in particular shall mean that at least a section of the burner grate is positioned and runs above the top face side of the gas burner. The burner grate shall have sufficient mechanical strength for supporting and carrying customary cooking vessels adequate for the gas cooking hob.

The burner grate may be implemented as a grid like structure comprising several support arms. The support arms at one end may be adapted to be placed and supported on a cooking face, whereas distant end sections of the support arms may protrude over and above the gas burner. End sections protruding above the gas burner in particular are adapted to support cooking vessels in a predefined distance from the gas burner, in particular gas or flame outlet ports of the gas burner.

The proposed burner grate further comprises at least one integrated feeder duct. The at least one feeder duct extends from an outer region of the burner grate to a mid section thereof. The proposed at least one feeder duct is adapted and implemented for feeding air towards the mid section, in particular the mid section to be positioned over and above the gas burner.

In the sense of the present invention, a feeder duct in particular may be a type of elongated channel running from the outer region towards the mid section. The mid section in particular shall be understood to represent the section of the grate, lying, when placed over a gas burner, above the gas burner, preferably above a center region or area of the gas burner.

The feeder duct may be a channel which is open at both ends, where one opening represents an air inlet opening and the other opening represents an air outlet opening. The air inlet opening is located in the outer region, preferably outside the region that will be placed and positioned over the gas burner. The air outlet opening is located in the inner region, preferably within the region that will be placed and positioned over the gas burner.

The feeder duct may be implemented as a separate constructional element, firmly attached or mounted, i. e. welded, to the burner grate. In the alternative, the feeder duct may be implemented together with the grate, in particular a support arm thereof, preferably in a one piece configuration. In particular in the latter case, the feeder duct may be an inner duct or channel running inside the burner grate.

One advantage of the proposed burner grate is that via the at least one feeder duct, air can be supplied to the mid section of the gas burner as such arranged below the burner grate. In particular, air can be supplied to regions above the gas burner, in particular to inner regions above the gas burner. Note that the term "inner" shall relate to the lateral dimension of the gas burner only, i. e. it shall be independent on axial heights.

Regarding the combustion process, in particular gas flames, of the gas burner, the air supplied via the proposed feeder duct represents secondary air, generally needed for optimal combustion processes in gas burners. Hence, secondary air can be supplied to gas or flame outlet ports, or even flames, in inner regions of the gas burner. A further, in particular constructional advantage of the proposed burner grate is, that providing the feeder ducts with, or even within, the burner grate is comparatively simple, and manufacturing costs can be kept low.

In one preferred embodiment of the burner grate, there are provided several support shafts, or support arms, extending between the outer region and the mid section. With this embodiment, at least one support shaft comprises at least one of the at least one feeder duct. Preferably, at least one feeder duct is an inner duct or channel of the at least one support shaft.

Providing one or more feeder ducts as inner ducts or channels in support shafts or arms may be advantageous with respect to construction and manufacture of the burner grate. Further, secondary air supply may be obtained without requiring serious technological and constructional changes to the overall geometry of known burner grates. Support shafts or arms generally have sufficient mechanical strength to cope with additional inner ducts or channels.

In a further embodiment, the burner grate comprises at least one fan. The fan is adapted to generate an airflow in the duct, which airflow is directed towards the mid section.

The fan preferably is arranged within the feeder duct, advantageously near an air inlet opening of the feeder duct. The air inlet opening preferably is arranged in an outer section of the burner grate, in particular such that air from a lateral vicinity of the gas burner can be sucked in.

Using a fan has the advantage that a forced airflow, and hence a forced secondary air supply can be obtained. This may be advantageous for optimal combustion. In addition, the airflow, and hence supply of secondary air to the gas burner, can be controlled by adequately controlling the operation of the fan.

Here, an electronic control unit may be provided, adapted to control the fan according to respective combustive requirements.

It shall be mentioned, that providing a fan, or providing a fan in or for each of the feeder ducts is not mandatory. Note that an adequate airflow may be obtained by natural suction effects, in particular Venturi effects, induced by burning flames of the gas burner. Here, the feeder duct, in particular exit openings thereof, may be adequately designed, for example in form of nozzles, such that respective burning flames induce an airflow, i. e. a flow of secondary air, towards the burning flames.

A further possibility is to supply air to the feeder duct from an air supply unit, in particular comprising a chamber and/or fans, arranged below the cooking face. In this case, the cooking face may comprise air outlet openings to be connected or coupled to respective air inlet openings of the feeder ducts.

It shall be mentioned, that a feeder duct may comprise a single or several air inlet openings. For example if several air inlet openings are provided, one air inlet opening may be adapted to be coupled to the air supply unit arranged below the cooking face. A further one of the air inlet openings may be adapted to suck in air from the environment nearby the gas burner and so on. Note that either a common or separate air inlet openings may be provided for supplying air by natural suction or fan-driven forced convection.

According to claim 4, a gas cooking hob is provided, which is adapted to be used with a gas stove top. The gas cooking hob comprises at least one gas burner and at least one burner grate according to any embodiment and configuration described above and further below.

A respective burner grate is positioned over a respective gas burner. According to the description further above, the burner grate, or as the case may be the burner grates, is/are adapted and configured to support cooking vessels and the like.

The burner grate may comprise a supporting structure, in particular supporting elements at least partially running above the gas burner top side in a predefined distance. Hence, cooking vessels, such as pans or pots, can be placed on the cooking hob, wherein the bottom side of a cooking vessel placed on the burner grate is spaced form the gas burner top face side by the predefined distance. The predefined distance may be selected such that optimal combustion and heating efficiency can be obtained. Here, characteristics of the respective gas burner, in particular gas and/or flame outlet ports thereof, may be of relevance.

With the proposed gas cooking hob, the burner grate is positioned over the gas burner and the burner grate is designed in such a way that that an air outlet opening of the feeder duct is located above the gas burner and in a mid section, i. e. an inner section, thereof.

The expression "located above the gas burner" and "in a mid section thereof" in particular shall mean, that the air outlet opening is located or situated above the top face side of the gas burner, and with respect to a top view of the gas burner within the top face side of the gas burner. In particular, the term "mid section" shall refer to the area limited by and lying within the outer rim of the top face side of the gas burner. Further reference is made to the definition of "inner" above. The term "top face side" shall refer to the upper side of the gas burner, in particular a top cap of the gas burner, in an ordinary operational position of the gas burner.

Note that the term "an air outlet opening" shall be understood in terms of "at least one air outlet opening". Therefore, the burner grate can comprise several air outlet openings located in a mid section and above the gas burner. Similarly, and for sake of completeness, the term "an air inlet opening" shall be understood in terms of "at least one air inlet opening".

Via the feeder duct, it is possible to supply air to the mid section above the gas burner. The air thus supplied may represent secondary air for combustion processes of the gas burner. This is of particular advantage for effective combustion, if the gas burner has inner gas and/or flame outlet ports arranged within the top face side and distant from the outer top rim of the gas burner.

Hence, in an embodiment of the gas cooking hob, it is provided that the gas burner comprises, with respect to the center axis thereof, outer and inner gas and/or flame exit ports, wherein the air outlet opening, i. e. the at least one air outlet opening, is adapted and located to supply air to flames of the inner gas and/or flame exit ports.

Gas and/or flame exit ports arranged within the top face side, i. e. inner gas and/or flame exit ports, may for example be implemented with a gas burner of a further embodiment having several concentric burner crowns. The concentric burner crowns respectively may comprise a plurality of gas and/or flame exit ports. With this embodiment, the air outlet opening is adapted and located to supply air to flames of gas and/or flame exit ports of inner burner crowns. In particular secondary air can be supplied to combustion processes at inner burner crowns.

As can be seen, in particular with respect to constructional issues, providing a burner grate with at least one feeder duct having an air outlet opening, i. e. at least one air outlet opening, as described further above, is a comparatively comfortable way to obtain sufficient secondary air supply even to combustion regions in the mid section, i. e. inner section, of the gas burner.

According to claim 7, a gas stove top is provided which comprises at least one gas cooking hob according to any embodiment and configuration described above.

As to advantages and advantageous effects of the gas stove top, reference is made to the description above and further above as well as further below.

In one embodiment of the gas stove top, the gas stove top comprises a cooking face in or to which the gas cooking hob is connected. In this embodiment, the cooking face comprises an air supply outlet opening, which is fluidly connected to an air inlet opening of the feeder duct.

In particular, the air supply outlet opening establishes a fluid connection with an air inlet opening of at least one feeder duct. Via the air supply outlet opening an airflow may be obtained by natural suction processes and/or forced supply of air to the feeder duct. If a fan and the like is located upstream the air supply outlet opening, a forced airflow can be obtained. A respective fan may for example be positioned below the cooking face.

In a further embodiment, the gas stove top may comprise an air supply unit, preferably arranged below a cooking face or gas stove top surface. The air supply unit may be adapted to feed air to an air inlet opening of the feeder duct. The air supply outlet opening provided within the gas stove top surface, i. e. the cooking face, may be part of the air supply unit and supplied with air from the air supply unit. By providing an air supply unit, supply of air to the feeder duct may be controlled according to respective needs. For controlling supply of air, an electronic control unit may be provided adapted to control for example fans or similar elements or components adapted for generating a forced airflow.

In a further advantageous embodiment, the air supply unit may comprise an air supply chamber arranged below the gas stove top. The air supply chamber may comprise a supply chamber outlet which is connected to an air inlet opening of at least one of the at least one feeder duct.

Within the air supply chamber there may be provided a fan for generating a forced airflow through and towards the air outlet openings of the feeder duct. A forced airflow may in the alternative or additionally be obtained by generating a positive pressure or overpressure within the air supply chamber. For generating the overpressure, at least one fan and/or even a compressor may be used.

In a yet further embodiment, the burner grate is positioned removably on the gas stove top. An air tight connection between the feeder duct and air outlet opening of the gas stove top or cooking face is automatically established upon putting the burner grate on the gas stove top. Here, suitable gaskets may be used for obtaining air tight connections. Providing a removable burner grate may be advantageous with respect to cleaning aspects.

According to claim 14, a gas stove is provided, which comprises a gas stove top according to any embodiment and configuration described above and below.

Figure 2:
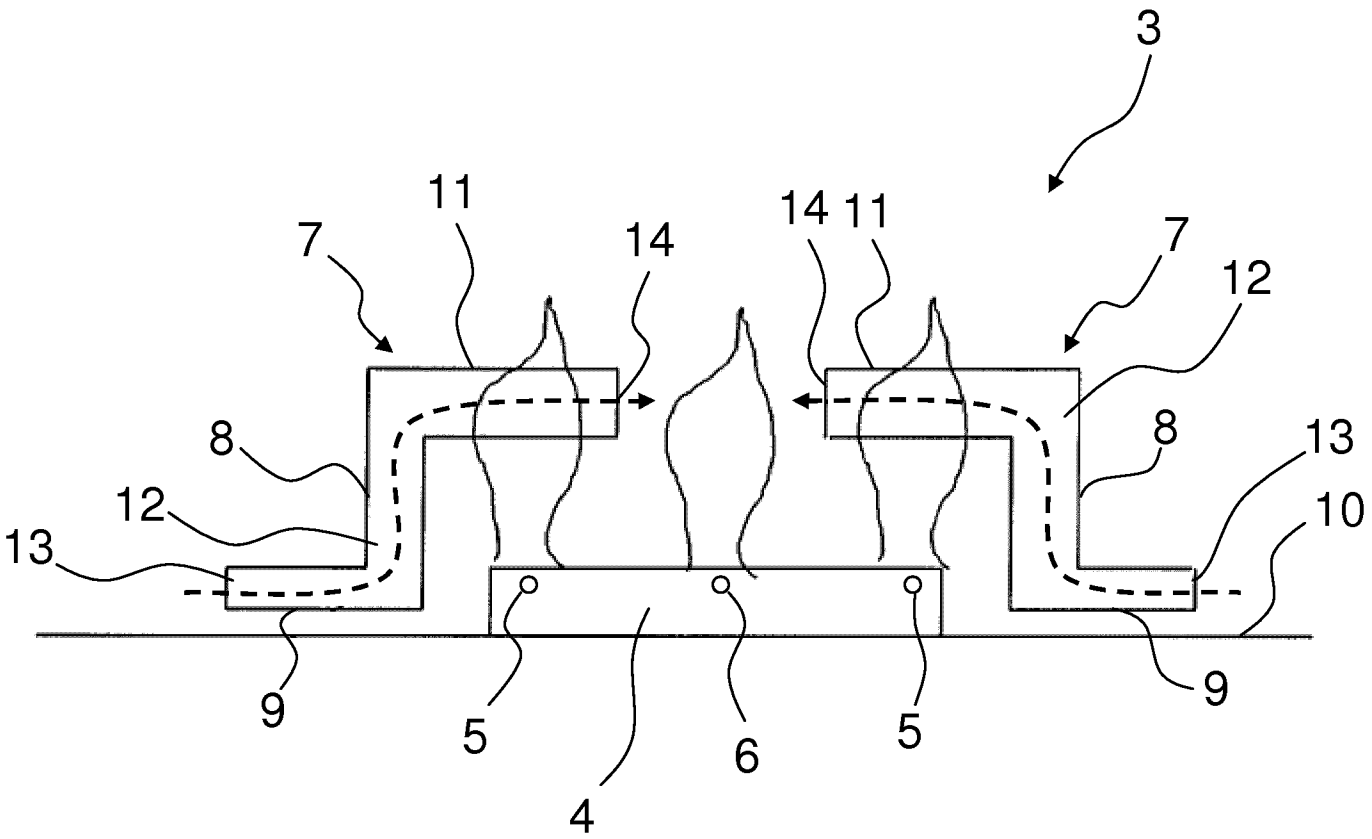
Figure 3:
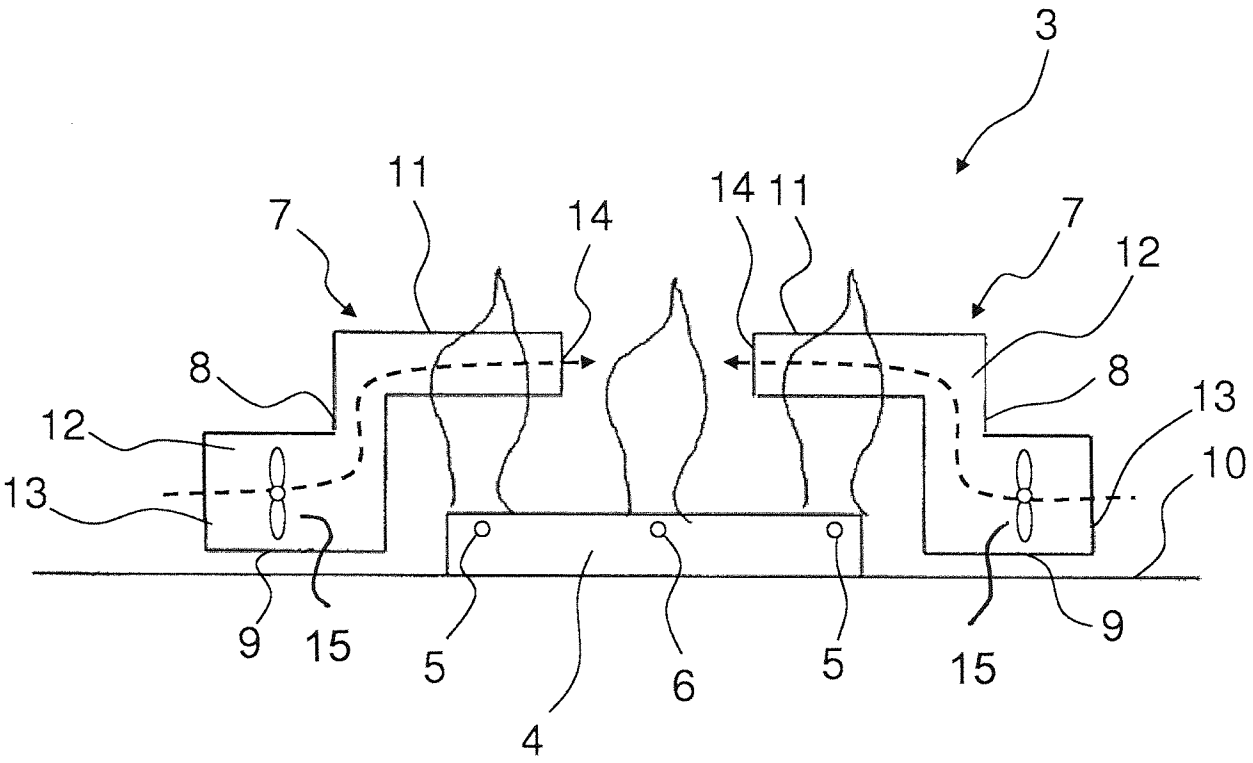
Figure 4:
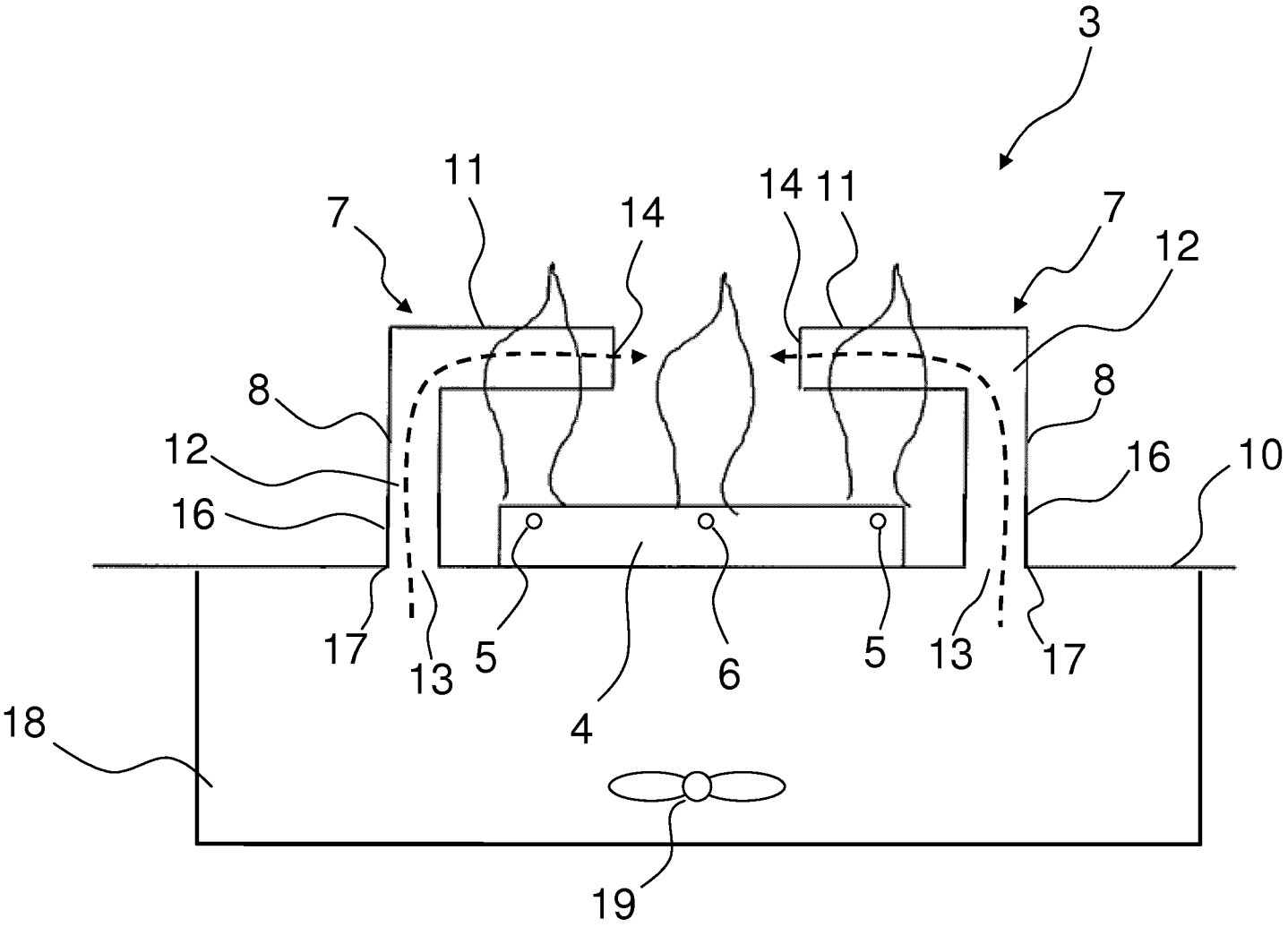

Selected embodiments will now be described in connection with the annexed figures, in which FIG. 1 shows a perspective view of a gas stove, FIG. 2 shows a schematic sectional view of a first configuration of a gas cooking hob;

FIG. 3 shows a schematic sectional view of a second configuration of a gas cooking hob; and FIG. 4 shows a schematic sectional view of a third embodiment of a gas cooking hob.

In the figures, like elements will be designated with like reference signs, as far as not otherwise stated.

FIG. 1 shows a perspective view of a gas stove 1. The gas stove 1 comprises a gas stove top 2. The gas stove top 2 comprises several, in total four, gas cooking hobs 3.

FIG. 2 shows a schematic sectional view of a first configuration of a gas cooking hob 3. The gas cooking hob 3 comprises a gas burner 4. The gas burner 4 comprises several concentric burner crowns. An outer burner crown has respective outer gas or flame outlet ports 5, wherein an inner burner crown has respective inner gas or flame outlet ports 6. Note that the terms outer and inner shall relate to the vertical center axis of the gas burner 4. The inner gas or flame outlet ports 6 can be considered to be arranged or positioned in a mid section of the gas burner top face.

In operation, gas exiting the gas outlet ports 5, 6 will result, after ignition, in gas flames, schematically shown in the figures. The gas flames will heat cooking vessels placed on the gas cooking hob 3.

For supporting cooking vessels, such as pans or pots, the gas cooking hob 3 further comprises a burner grate 7. The burner grate 7 is positioned over the gas burner 4 and, as already mentioned, adapted to support cooking vessels to be placed on the cooking hob 3.

In the configuration shown in the figures, the burner grate 7 comprises a support structure, preferably of grid like design. The support structure comprises several, preferably four angularly equally spaced, support arms 8, two of which are respectively visible in the figures. The support arms 8 may be inter-connected by struts or similar elements.

A first end section 9 of the support arm 8 is adapted to be placed, and as the case may be mounted, on or to a cooking face 10 of the gas stove top 2. A second end section 11 of the support arm 8, in the present case running essentially in horizontal direction, is adapted to support cooking vessels in a predefined distance above the gas burner top face side. Mid sections of the support arms 8, connect the first 9 and second end sections 11, and in the present case run in vertical direction between the first 9 and second end sections 11.

The endpoints of the second end sections 11 are positioned above the mid section or inner area of the gas burner top face side.

The burner grate 7 comprises integrated feeder ducts 12. The feeder ducts 12 in the present case are implemented as channels running within the support arms 8. In other words, each support arm 8 comprises one, or more generally at least one, inner channel.

The feeder ducts 12 in the present case extend over the whole length of respective support arms 8, wherein respective air inlet openings 13 are defined at face sides of the first end sections 9 and respective air outlet openings 14 are defined at face sides of the second end sections 11.

Coming now to the feeder ducts 12, in particular the air inlet openings 13, the air outlet openings 14 and the channel running therebetween. During operation of the gas burner 4, flames in the mid section of the gas burner 4, emanating from inner gas outlet ports 6, induce a natural suction effect, in particular Venturi suction effect, leading to an airflow in the feeder ducts 12. The airflow is directed from the air inlet openings 13 towards the air outlet openings 14. Note that the airflow is indicated in the figures by broken arrows.

As a consequence, air from an outer region of the gas burner 4 and near the cooking face 10 is fed towards the flames emanating from the inner gas outlet ports 6, i. e. existing in the mid section of the gas burner 4 and burner grate 7, respectively. Note that air is supplied to flames in a region above the gas burner top face side.

The air supplied to the flames acts as secondary air for respective combustion processes. As can be seen, secondary air can readily be supplied to combustion processes related to inner gas outlet ports 6. Hence respective combustion processes and therefore heating efficiency of the gas burner 4 can be optimized.

Providing feeder ducts 12 as described so far represents a comparatively effective way to obtain sufficient secondary air at inner combustion processes, in particular with respect to constructional effort.

It shall be mentioned, that the location of the air outlet openings 14, as well as air inlet openings 13 is not restricted to respective face sides of the support arms 8. Rather, air outlet openings 14 and air inlet openings 13 may be provided at different locations as far as secondary air supply to inner combustion processes can be enhanced. Further, only one air outlet opening 14 and only one air inlet opening 13 has been described with the burner grate 7 of FIG. 1. It shall be mentioned, that several or even a plurality of air outlet openings 14 and air inlet openings 13, respectively, may be provided. This also shall apply for any other embodiments and configurations of the burner grate.

Further, it shall be mentioned that the feeder ducts 12, in particular the air outlet openings 14, the air inlet openings 13 and the channel defined therebetween may be dimensioned such that sufficient airflow can be obtained. However, the channel and/or the support arms 8 should be dimensioned such that the support arms 8 have sufficient mechanical strength to support all possible and customary types of cooking vessels.

FIG. 3 shows a schematic sectional view of a second configuration of a gas cooking hob 3. The second configuration differs from the first configuration in that in each first end section 9 of the support arms 8 there is provided a fan 15. This means, that the fans 15 are positioned within the feeder ducts 12.

In order to fit the fans 15 into the feeder duct 12, the diameter of the feeder duct 12 is enlarged in the first end sections 9 as compared to the first configuration.

The fans 15 are adapted to generate an airflow, indicated again by broken arrows, directed from the air inlet openings 13 towards the air outlet openings 14. In this way, air, which again acts as secondary air, can be supplied to inner combustion processes. Using fans 15, a forced airflow can be obtained, which may be advantageous if natural suction effects are too weak.

A manual and/or electronic controller may be provided to control the fans 15. In one configuration, the fans 15, or at least one fan 15, may be activated whenever the gas burner 4 is activated. In another configuration of operating the fans 15, it shall be possible to operate the gas burner 4 whilst the fans 15 are deactivated. In this case, secondary air may be supplied by natural suction effects. If combustion processes, in particular inner combustion processes related to flames of inner gas outlet ports 6, become inefficient, the fans 15, or at least one of the fans 15, may be activated. Analogously, one or more fans 15 may be deactivated if sufficient secondary air can be supplied by natural suction effects. Efficiency of combustion processes may be monitored by suitable sensors, and sensor signals may be used by the electronic controller to activate and/or deactivate the fans 15.

FIG. 4 shows a schematic sectional view of a third embodiment of a gas cooking hob 3. The third embodiment differs from the first and second embodiment in that horizontal sections of the first end sections 9 of the support arms 8 are omitted. Instead, vertical sections 16 of the support arms 8 are directly supported on the cooking face 10. The air inlet openings 13 of the feeder ducts 12 are provided at lower face sides of the vertical sections 16.

The support arms 8 in the third configuration are designed and positioned on the cooking face 10 in such a way that the air inlet openings 13 are fluidly connected to air supply outlet openings 17 provided in the cooking face 10. Air tight connections between the air inlet openings 13 and the air supply outlet openings 17 may be obtained by suitable gaskets.

In the present configuration, as well as in the first and second configuration described further above, the burner grate may be removably placed on the cooking face 10.

Below the cooking face 10, there is provided an air supply chamber 18 extending over the air supply outlet openings 17. The air supply outlet openings 17 define chamber outlets of the air supply chamber 18.

Within the air supply chamber 18 there is provided a further fan 19. By operating the further fan 19, a forced airflow towards the air outlet openings 14 can be obtained. Hence, secondary air can be supplied to inner combustion processes of the gas burner 4.

With respect to operating the further fan 19, reference is made to the description above, i. e. relating to the fans 15, which shall apply mutatis mutandis. In particular, it may be provided that the further fan 19 can be operated by a controller, either by a manual controller and/or automatically by an electronic controller. Further, it may be provided that the further fan 19 is activated upon activation of the gas burner 4. In a different operational mode, operation of the further fan 19 may be conducted independent from operation of the gas burner 4, which shall in particular mean, that the further fan 19 may be deactivated during operation of the gas burner 4. In the latter case, secondary air may be supplied by natural suction effects.

In all it becomes clear, that, in particular in contrast to state of the art solutions, the invention is effective in enhancing secondary air supply to flame outlet ports and flames located in inner regions of a gas burner.

LIST OF REFERENCE NUMERALS

1 gas stove
2 gas stove top
3 gas cooking hob
4 gas burner
5 outer gas outlet port
6 inner gas outlet port
7 burner grate
8 support arm
9 first end section
10 cooking face
11 second end section
12 feeder duct
13 air inlet opening
14 air outlet opening
15 fan
16 vertical section
17 air supply outlet opening
18 air supply chamber
19 further fan

The invention claimed is:

1. A gas stove top comprising:

at least one cooking hob and an air supply unit, the at least one cooking hob comprising:

a gas burner provided at a top surface of a cooking face; and two or more burner grates that are placed over the gas burner of the gas cooking hob to support a cooking vessel placed on the burner grates, wherein the gas burner comprises, viewed from above along a direction perpendicular to said top surface, an outer flame exit port and an inner flame exit port, wherein each of the burner grates comprises at least one integrated feeder tube having an air inlet opening at a first end of the integrated feeder tube connected to the cooking face and an air outlet opening at a second end of the integrated feeder tube configured to supply air to flames of the inner flame exit port, wherein each of the burner grates extends from said second end located above a mid section of the gas burner to the first end adjacent said air inlet opening, the mid section being located at a center of the gas burner wherein the inner flame exit port is disposed, the air outlet opening at said second end of the at least one integrated feeder tube being configured to feed air towards the mid section of the gas burner, wherein the air supply unit is provided under the cooking face and feeds air to the at least one integrated feeder tube of each said burner grate through the air inlet opening, the air supply unit comprising at least one fan positioned within a supply chamber equally distant from the air inlet opening of the at least one integrated feeder tube of each of the two or more burner grates, the fan feeding air to the supply chamber and to the air inlet opening of the at least one integrated feeder tube of each of the burner grates.

2. The gas stove top according to claim 1, wherein each of the burner grates comprises a support shaft extending between the air inlet opening of the at least one integrated feeder tube of the respective burner grate and the mid section of the gas burner, said at least one integrated feeder tube going through the support shaft of the respective burner grate.

3. A gas stove top comprising:

at least one gas cooking hob comprising:

a gas burner provided on a top surface of a cooking face; and two or more burner grates that are placed over the gas burner of the gas cooking hob and support a cooking vessel a placed on the burner grates, wherein the gas burner comprises, viewed in a direction perpendicular said top surface of the cooking face, an outer flame exit port and an inner flame exit port, wherein each of the burner grates comprises at least one integrated feeder tube having an air inlet opening at a first end of the integrated feeder tube provided above the cooking face and configured to suck in outside air and an air outlet opening at a second end of the integrated feeder tube configured to feed air to flames of the inner flame exit port, wherein each of the burner grates extends from a mid section of the gas burner to the air inlet opening, the mid section being located at a center of the gas burner above the inner flame exit port, and the second end of the at least one integrated feeder tube feeds air towards the mid section of the gas burner, and wherein at least one of the burner grates further comprises at least one fan adapted to generate an airflow in the at least one integrated feeder tube thereof, directed towards the mid section of the gas burner.

4. The gas stove top according to claim 1, wherein the gas burner comprises several concentric burner crowns respectively comprising the outer flame exit port and the inner flame exit port, wherein the air outlet opening is adapted and located to supply air to flames of the inner flame exit port of an inner one of said crowns.

5. The gas stove top according to claim 1, wherein the cooking face is connected in or to the gas cooking hob, and the cooking face comprises at least one air supply outlet opening fluidly connected to the air inlet opening of the at least one integrated feeder tube of each of the burner grates.

6. The gas stove top according to claim 1, the air supply unit comprising the air supply chamber arranged below the cooking face of the gas stove top, wherein at least one supply chamber outlet is connected to the air inlet opening of the at least one integrated feeder tube of each of the burner grates.

7. The gas stove top according to claim 1, wherein the burner grates are positioned removably on the cooking face of the gas stove top, and an air tight connection between the at least one integrated feeder tube of each of the burner grates and an air supply outlet opening of the air supply unit is automatically established upon putting the burner grates on the cooking face of the gas stove top.

8. The gas stove top according to claim 2, wherein the at least one integrated feeder tube of each said burner grate is an inner tube of the support shaft thereof.

9. The gas stove top according to claim 3, wherein the fan is arranged within the integrated feeder tube.

10. The gas stove top according to claim 3, wherein the integrated feeder tube comprises an inner section and outer section, and the fan is arranged in the outer section of the integrated feeder tube.

11. The gas stove top according to claim 1, wherein the at least one integrated feeder tube is an inner duct running inside of each of respective the burner grates.

12. The gas stove top according to claim 1, wherein the at least one integrated feeder tube comprises a channel running between the air inlet opening and the air outlet opening inside each said burner grate, the air inlet opening is provided at a first end section of the integrated feeder tube of each of said burner grate that is closer to the cooking face than the air outlet opening, and the air outlet opening is provided at a horizontal section of the integrated feeder tube of each said burner grate that is closer to burning flames of the gas burner than the air inlet opening.

13. The gas stove top according to claim 1, wherein the at least one integrated feeder tube comprises only one air outlet opening in one end provided above the mid section of the gas burner and only one air inlet opening connected to the cooking face at another end.

14. A gas stove top comprising:

a cooking hob and an air supply unit, the cooking hob comprising:

a gas burner provided at a top surface of a cooking face; and two or more burner grates placed over the gas burner to support a cooking vessel above the gas burner;

wherein each of the burner grates comprises at least one integrated feeder tube that has an air inlet opening at a first end of the integrated feeder tube adjacent to the cooking face and an air outlet opening at a second end of the integrated feeder tube disposed above a center of the gas burner and configured to supply air to flames of the gas burner, each of the burner grates comprising a horizontal section and a vertical support shaft, said integrated feeder tube extending from said inlet opening adjacent to said cooking face, through said vertical support shaft, then through said horizontal section to said outlet opening disposed in an end of said horizontal section such that said outlet opening is oriented axially with respect to said horizontal section.

15. The gas stove top according to claim 1, wherein the air outlet opening of the integrated feeder tube of each of the burner grates is oriented axially relative to the integrated feeder tube at said second end thereof.

16. The gas stove top according to claim 1, wherein the second end of the integrated feeder tube of each of the burner grates is an axial end of the integrated feeder tube.

* * * * *